US006206726B1

(12) United States Patent
Takahashi et al.

(10) Patent No.: US 6,206,726 B1
(45) Date of Patent: Mar. 27, 2001

(54) TOLERANCE ACCOMMODATING MOUNTING PAD FOR JUNCTION BOX COVER

(75) Inventors: Takeshi Takahashi, Novi; Brian L. Wagner, Ypsilanti, both of MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 09/506,185

(22) Filed: Feb. 17, 2000

(51) Int. Cl.[7] ..... H01R 13/73
(52) U.S. Cl. ..... 439/573; 220/3.3
(58) Field of Search ..... 174/138 D, 138 G, 174/138 F; 220/3.3, 3.8, 3.9, 914, 224, 539, 540; 439/573, 574

(56) References Cited

U.S. PATENT DOCUMENTS

| | | | | |
|---|---|---|---|---|
| 3,697,924 | * | 10/1972 | Oliver | 174/58 |
| 4,039,131 | | 8/1977 | Perrault et al. . | |
| 4,270,591 | | 6/1981 | Gill et al. . | |
| 4,295,575 | * | 10/1981 | Flachbarth | 220/3.8 |
| 4,546,408 | * | 10/1985 | Rodseth et al. | 174/138 D |
| 5,251,103 | | 10/1993 | Haberstroh et al. . | |
| 5,697,796 | * | 12/1997 | Harji et al. | 439/573 |
| 5,727,355 | | 3/1998 | Mitchell . | |
| 6,019,632 | * | 2/2000 | Ozai et al. | 439/573 |
| 6,109,979 | * | 8/2000 | Garnett | 439/573 |

* cited by examiner

*Primary Examiner*—Neil Abrams
*Assistant Examiner*—Phuong KT Dinh
(74) *Attorney, Agent, or Firm*—Young & Basile, P.C.

(57) ABSTRACT

A tolerance-accommodating, flexible mounting pad formed integrally in the base point mounting portion of a bussed electrical center cover. The base point of the bussed electrical center is adapted to be secured directly to a vehicle mounting surface, the location of which may vary due to dimensional variations within an expected tolerance range. The cover is typically secured by one or two fixed mounting points at an upper portion thereof to mounting points in the vehicle, and the tolerance-accommodating mounting pad is then used to secure the base point of the cover directly to the final vehicle mounting surface. If a gap exists between the base point and the vehicle mounting surface due to variations within the expected tolerance of the vehicle mounting surface, a fastener inserted through the mounting pad and engaging the mounting surface is operable to flex the normally recessed mounting pad outwardly into direct, tensioned contact with the vehicle mounting surface. In a preferred form, the pad is formed integrally from an inwardly-bowed band of the cover wall material, defined by two slots in the wall material. In a most preferred form the band has a multi-planar configuration with flex arms and mounting pad portions defined by bend lines.

16 Claims, 3 Drawing Sheets

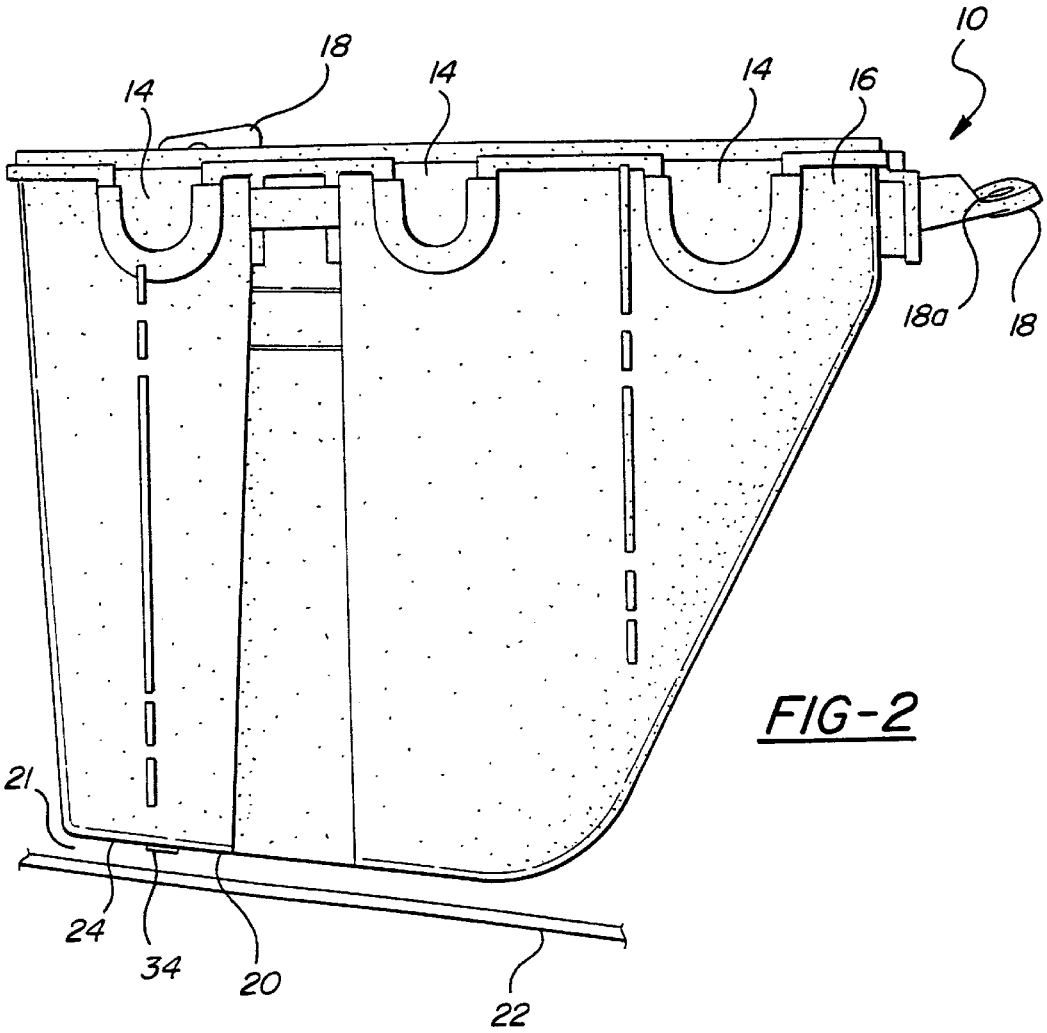
FIG-2
FIG-3B
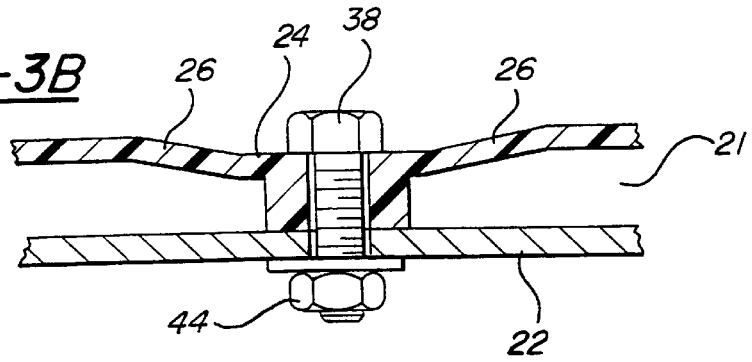

TOLERANCE ACCOMMODATING MOUNTING PAD FOR JUNCTION BOX COVER

FIELD OF THE INVENTION

This invention relates to molded plastic junction boxes or bussed electrical centers (BECs) of the type used in automotive vehicles, and more specifically to bolt mounting arrangements in BECs.

BACKGROUND OF THE INVENTION

A junction box or bussed electrical center (BEC) is typically used in automotive vehicles to streamline electrical wiring by eliminating multi-branch wiring. The BEC enables branch circuits, fuses, relays and other electrical circuit components to be consolidated in a single housing and connected by wire harnesses to electrical devices and systems on the vehicle. The BEC housing is usually located in the vehicle engine compartment. The BEC typically has a lower "cover" or housing mounted in the engine compartment via pre-molded mounting points such as bolt receiving tabs or pads. The BEC itself is placed in the prior-mounted lower cover.

The BEC cover is often intricately molded, with a multi-faceted, curved, angled, and irregular outer surface to accommodate the usually cramped mounting location in the vehicle engine compartment. The cover also tends to be heavy, with thick, substantially rigid plastic walls, often weighing several pounds.

BEC covers often include tab type bolt mounting points, and a "base point" intended to be attached directly to a vehicle mounting surface. Prior art base points are typically bolt apertures through a portion of the BEC cover whose outer surface is adapted to be secured directly against a vehicle mounting surface. The fixed base point is intended to be secured to non-tolerance portions of a vehicle, such as a shock tower, where variation in the position of a vehicle mounting surface is not a concern. In the event of base point variations, the tab type mounting points are made thin enough and flexible enough to dampen vibration and adjust somewhat to tolerance problems at the base point. However, subjected over time to vibration, upper flex points thin enough to accommodate base point tolerances tend to break.

In newer vehicles, sheet metal now forms part of the "unibody" structural frame, often comprising several overlapping layers of welded sheet metal. This results in significant dimensional tolerances at the traditional base point mounting surface for BEC covers. Because the BEC cover is heavy, the two fixed top mounting tabs are not enough to handle the vibration resulting from any gap or spacing between the BEC cover base point and its vehicle mounting surface.

SUMMARY OF THE INVENTION

The invention is a tolerance-accommodating fastener mounting pad integrally molded at the base point in the plastic lower cover of a bussed electrical center. The mounting pad is sufficiently flexible to accommodate the typical tolerances encountered when securing a fastener through the pad to a vehicle mounting surface (e.g., +/−2 mm), and is sufficiently rigid to prevent BEC cover vibration once the mounting pad has been secured against the vehicle mounting surface.

In a preferred form, the mounting pad is formed as an inwardly-bowed band or web of the BEC cover wall material, defined by two parallel slots which leave the ends of the band intact with the cover. The band is preferably angular, with three planar portions formed by bends that give it a degree of flexibility. The band is initially angled inwardly relative to the base point. When the cover is positioned in an engine compartment of a vehicle with the base point adjacent the vehicle mounting surface, a fastener (e.g., a bolt) is inserted through an aperture in the mounting pad and secured to the vehicle mounting surface. As the fastener is tightened, the band of material supporting the mounting pad is pulled downwardly toward the mounting surface such that the mounting pad is secured under tension against the vehicle mounting surface.

This invention, together with other objects, features, aspects and advantages thereof, will be more clearly understood from the following description, considered in conjunction with the accompanying drawings.

BRIEF DESCRIPTION OF THE DRAWINGS

FIG. 2 is a side elevational view of the BEC cover of FIG. 1.

FIG. 3B illustrates the pad of FIG. 3A in a flexed, extended position fastened to the vehicle mounting surface.

DETAILED DESCRIPTION OF THE ILLUSTRATED EMBODIMENT

Figure 1:
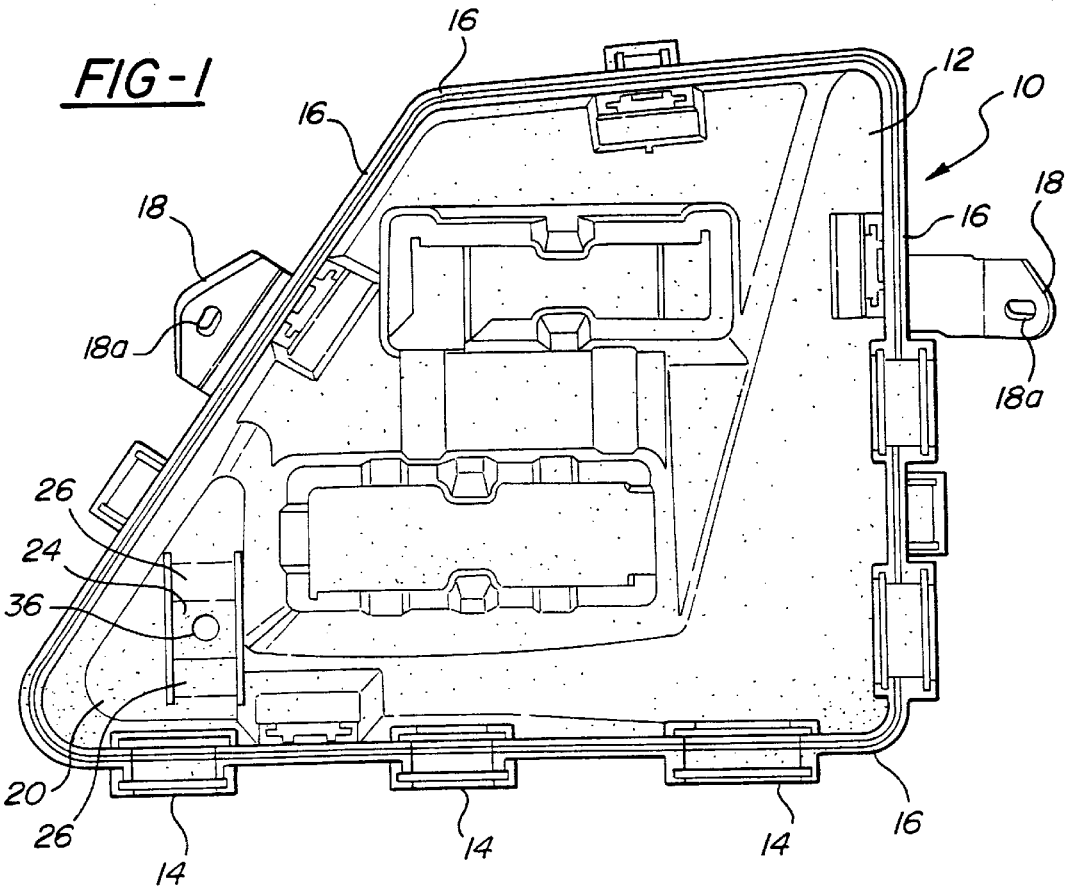
FIG. 1 is a top plan view of the interior of a BEC lower cover, including a tolerance-accommodating mounting pad according to the present invention.
Figure 3A:
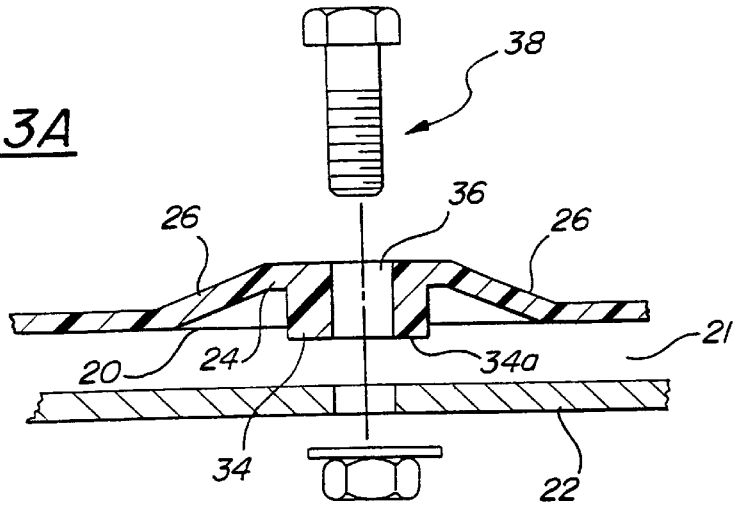
FIG. 3A is a side section view of the inventive mounting pad in an at-rest, non-fastened condition relative to an adjacent vehicle mounting surface.
Figure 4:
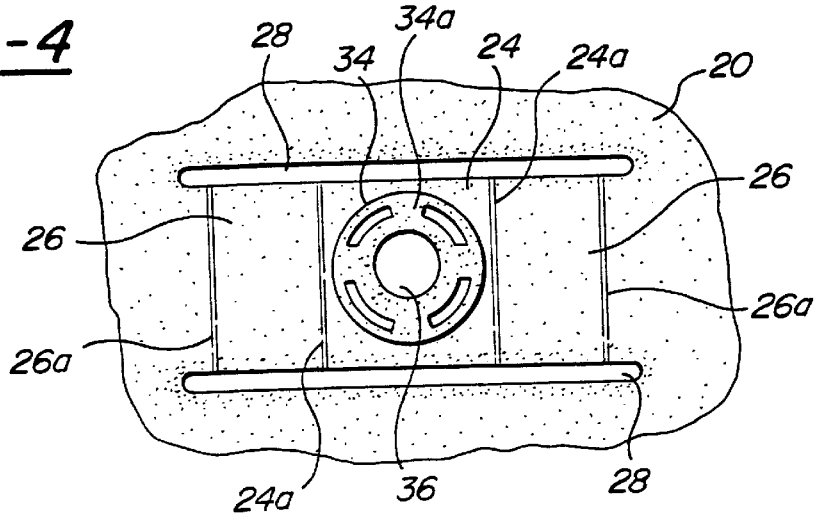
FIG. 4 is an enlarged, detailed view, bottom plan view, of the inventive mounting pad viewed from the bottom of the BEC cover.
Figure 5:
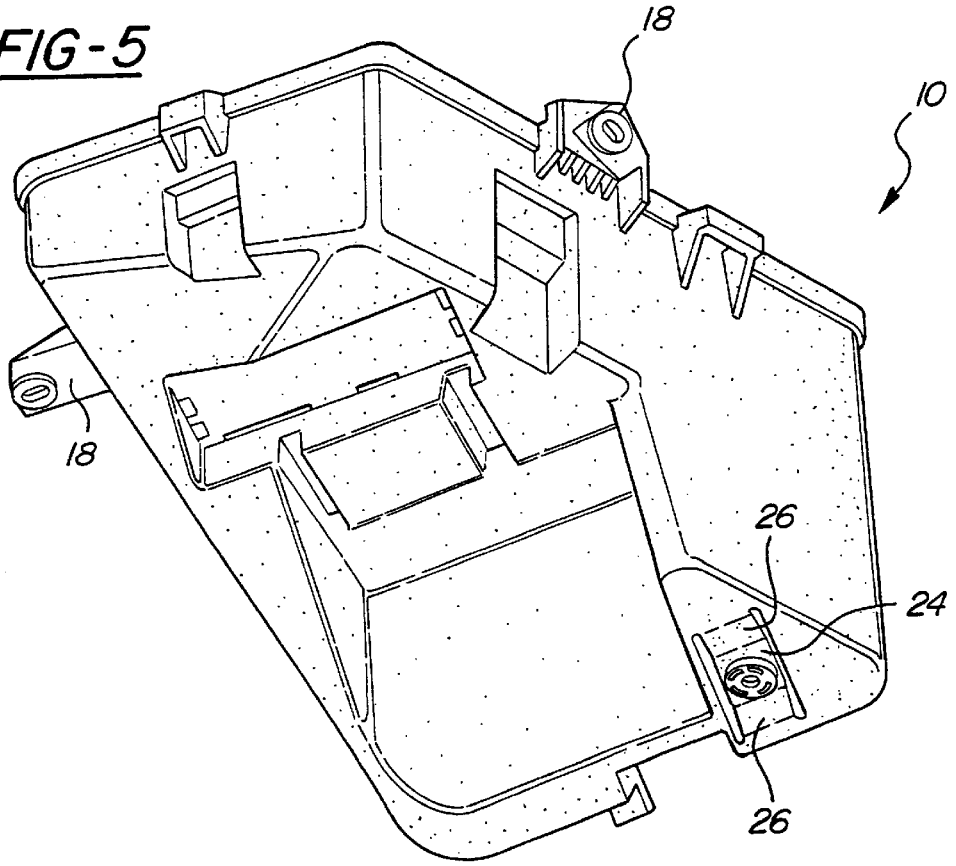
FIG. 5 is a bottom perspective view of the inventive mounting pad and BEC cover, showing the relative positions of the two fixed mounting points at the upper edge of the BEC cover and the mounting pad at the base point of the BEC cover.

Referring first to FIGS. 1 and 2, a representative BEC lower cover 10 has an interior 12 for receiving a bussed electrical center of known type (not shown). The cover includes multiple ports 14 for the entry of wire harnesses from various vehicle electrical systems through walls 16. Fixed, integrally molded mounting tabs 18 are used to position and secure the cover to brackets or mounting surfaces in the engine compartment of a vehicle. A base point 20 of the cover is intended to be secured directly to a vehicle mounting surface, usually a vehicle body panel 22 formed from one or more layers of sheet metal. Body panel 22, however, is often separated from the base point 20 by a gap 21 due to dimensional variations within an accepted tolerance range (e.g., +/−3 mm). For stability and reliability of the base point connection, at least a portion of base point 20 should be mounted directly against the vehicle mounting surface. A direct mount becomes difficult, however, when vehicle assembly tolerances allow variation in the location of the sheet metal, and when mounting tabs 18 are rigid and non-adjustable for strength.

According to the present invention, an adjustable mounting pad 24 is provided at base point 20 to account for the tolerances and provide a direct mount against the vehicle mounting surface. The illustrated pad 24 is generally rectangular and is joined by two flexible ends or arms 26 to the bottom of lower cover 10 at base point 20. As best shown in FIGS. 3A, 3B, 4 and 5, the pad 24 and ends 26 are part of an integral web or band of the thick plastic wall material of the lower cover. The band is defined and separated from the cover by two parallel slots 28 extending through the bottom wall of the cover. The band is integrally formed with the lower cover, for example when the lower cover is molded from nylon or some other suitable non-conductive plastic. The band is curved or angled inwardly into the interior of the lower cover in its molded, at-rest position. Pad 24 is generally parallel to but spaced inwardly from the exterior surface of the cover at base point 20.

Although the preferred embodiment is shown as a multi-planar band with flat, planar arms separated by clearly defined bends, it may also be possible to form part or all of the band bowed inwardly in curved fashion to provide a similar at-rest tension and tolerance-accommodating flexibility toward the vehicle mounting surface. In general, however, the multi-planar band illustrated is preferred both for ease of molding as well as precise and even adjustment.

In the illustrated embodiment, the exterior-facing surface of pad 24 has a raised pedestal 34, in the illustrated embodiment a cylindrical plug or disk portion integrally formed with pad 24. Pedestal 34 includes a passage or aperture 36 for receiving a fastener such as bolt 38, as illustrated in the FIG. 3B assembly view, while base 34*a* of pedestal 34 provides a stop surface for engaging the vehicle mounting surface in lieu of pad 24 or the surrounding BEC cover wall material. A fastener such as bolt 38 inserted through aperture 36 is preferably secured from inside the lower cover in a blind operation to a mating structure on the vehicle mounting surface, for example a nut 44 as shown. The nut may be of the captured, non-rotatable type in a true blind operation where the opposite side of mounting surface 22 is not accessible to the person installing the BEC cover.

As the bolt is progressively threaded, mounting pad 24 and in particular stop face 34*a* on pedestal 34 is pulled into contact with vehicle mounting surface 22. Depending on the extent of gap 21, the band comprising mounting pad 24 and arms 26 may be bent or bowed outwardly from the underside of the lower cover, as depicted in FIG. 3B, to the extent necessary to accommodate the spacing 21 between the mounting surface and the base point of the lower cover. The resulting tensioned contact between the BEC mounting pad and vehicle mounting surface stabilizes the lower cover against vibration without unduly loading fixed tab-type mounting points 18 on the upper end of the cover.

Alternatively, the vehicle mounting surface may be provided with a threaded hole instead of a nut or captured nut. In other embodiments or environments, a threaded stud may extend from the vehicle mounting surface to be received by the annular passage 36 in mounting pad 24. A nut would then be threaded onto the stud in cover 10 until seated against pad 24, and would then be further tightened to flex mounting pad 24 (and in particular a stop surface such as 34*a*) against the vehicle mounting surface.

It is also possible to provide passage 36 with internal threads to hold a bolt to the mounting pad in a pre-assembly condition.

While the invention has been described with reference to a BEC lower cover, it will be understood that the inventive mounting pad can be applied to other types of molded plastic covers or components in a vehicle where the tolerance of a vehicle mounting surface relative to a "base point" portion of the component and one or more fixed mounting points may vary, and a vibration-free, direct contact with the vehicle mounting surface is desired.

It will also be understood that the degree of bend or angle in the flexible band comprising the mounting pad, the thickness or flexibility of the band of material, the relative dimensions of the arms 26 and pad 24, and other such factors may vary to accommodate different tolerances and vibration-resisting requirements.

It will further be understood that while the "base point" mounting pad location is illustrated on a bottom portion of the BEC cover, a base point using the inventive mounting pad may be located elsewhere on the surface of the BEC, depending largely on the desired contours of the cover and the location of the best available vehicle mounting surface.

Since minor changes and modifications varied to fit particular operating requirements and environments will be understood by those skilled in the art, this invention is not considered limited to the specific examples chosen for purposes of illustration. The invention is meant to include all changes and modifications which do not constitute a departure from the true spirit and scope of this invention as claimed in the following claims and as represented by reasonable equivalents to the claimed elements.

What is claimed is:

1. In combination with a molded plastic vehicle component such as a bussed electrical center having one or more fixed mounting points and a base point for connection to a vehicle mounting surface likely to vary in location relative to the fixed mounting points, a mounting pad for enabling the base point of the component to be connected directly to the vehicle mounting surface, the mounting pad comprising:

a flexible band of molded plastic material integrally molded in the component at the base point; and a mounting pad on the band adapted for movement with the flexible band between a rest position spaced from the vehicle mounting surface and a mounted position secured against the vehicle mounting surface under tension.

2. The combination of claim 1 further comprising fastener means for moving the mounting pad to the mounted position and securing the mounting pad to the vehicle mounting surface.

3. The combination of claim 2 further comprising an aperture in the mounting pad for receiving the fastener means.

4. The combination of claim 3 wherein the fastener means is a bolt and the aperture is adapted to receive a shank of the bolt.

5. The combination of claim 4 wherein the pad further includes a raised pedestal portion through which the aperture extends.

6. The combination of claim 5 wherein the pedestal further includes an exterior face spaced from the mounting pad and adapted to be secured directly against the vehicle mounting surface.

7. The combination of claim 1 wherein the band is defined between two slots in wall material of the component.

8. The combination of claim 7 wherein the slots are parallel to each other, and the band is generally rectangular.

9. The combination of claim 7 wherein the band comprises two angled arms, each of the arms having a first end joined to the component and a second end joined to the mounting pad.

10. The combination of claim 9 wherein the arms are angled away from the mounting surface in the first position.

11. The combination of claim 1, wherein the band is angled or curved upwardly into the interior of the component away from the vehicle mounting surface in a rest position.

12. A lower cover for a bussed electrical center, said lower cover comprising:

an interior adapted to receive the bussed electrical center; and a mounting assembly for securing the lower cover to a vehicle mounting surface, the mounting assembly including a flexible band having two ends joined to the cover, the band further having an intermediate mounting pad portion bowed into the interior of the cover in an initial rest position, the band being sufficiently flexible to allow the mounting pad portion to be moved to a secured position against the vehicle mounting surface under tension of a fastener engaging the band and vehicle mounting surface.

13. The lower cover of claim 12 wherein the band is formed integrally with the material of the lower cover.

14. The lower cover of claim 12 wherein the cover includes a base point surface adapted to directly engage the vehicle mounting surface, and the flexible band is formed in the base point surface.

15. The lower cover of claim 14 wherein the intermediate mounting pad portion is substantially parallel to the base point surface and is located in the interior of the cover in the rest position.

16. The lower cover of claim 12 wherein the intermediate mounting pad portion includes a raised fastener-receiving portion extending toward the vehicle mounting surface.

* * * * *